US006981901B2

(12) United States Patent
Takaya

(10) Patent No.: US 6,981,901 B2
(45) Date of Patent: Jan. 3, 2006

(54) TERMINAL DEVICE OF ELECTRICAL APPARATUS

(75) Inventor: Kouetsu Takaya, Saitama (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 11/107,858

(22) Filed: Apr. 18, 2005

(65) Prior Publication Data

US 2005/0255757 A1 Nov. 17, 2005

(30) Foreign Application Priority Data

May 11, 2004 (JP) ..... 2004-140733

(51) Int. Cl.
*H01R 4/36* (2006.01)

(52) U.S. Cl. ..... 439/812; 439/166

(58) Field of Classification Search ..... 439/166, 439/709, 712, 801, 810, 812
See application file for complete search history.

(56) References Cited

U.S. PATENT DOCUMENTS 3,452,317 A * 6/1969 Carlson ..... 439/431
3,888,560 A 2/1974 Smith et al.
4,136,924 A 1/1979 Dobrosielski et al.
4,210,379 A * 7/1980 Vachhani et al. ..... 439/406
5,741,153 A * 4/1998 Schwer ..... 439/491
5,772,479 A 6/1998 Fleege et al.
6,036,542 A * 3/2000 Montague et al. ..... 439/595
6,224,430 B1 * 5/2001 Kusuda et al. ..... 439/709
6,379,196 B1 4/2002 Greenberg et al.
6,733,347 B2 * 5/2004 Palet Mercader et al. .. 439/810

FOREIGN PATENT DOCUMENTS

JP 2002-190331 7/2002

* cited by examiner

*Primary Examiner*—Tho D. Ta
*Assistant Examiner*—James R. Harvey
(74) *Attorney, Agent, or Firm*—Manabu Kanesaka

(57) ABSTRACT

A terminal device of an electrical apparatus includes a frame, at least one attachment piece and at least one terminal strip with a terminal screw, The frame includes at least two side walls with grooves, a bottom wall disposed between the at least two side walls and having a first recess, and a rear wall standing from the bottom wall to form a box-shaped space. The attachment piece is fitted into the box-shaped space, and has a cylinder-shaped recess and a lower surface with a projection for engaging the first recess. The terminal strip is inserted into the box-shaped space along the grooves so that the terminal screw is fitted into the cylinder-shaped recess for attaching the terminal strip to the attachment piece.

4 Claims, 7 Drawing Sheets

Fig. 3
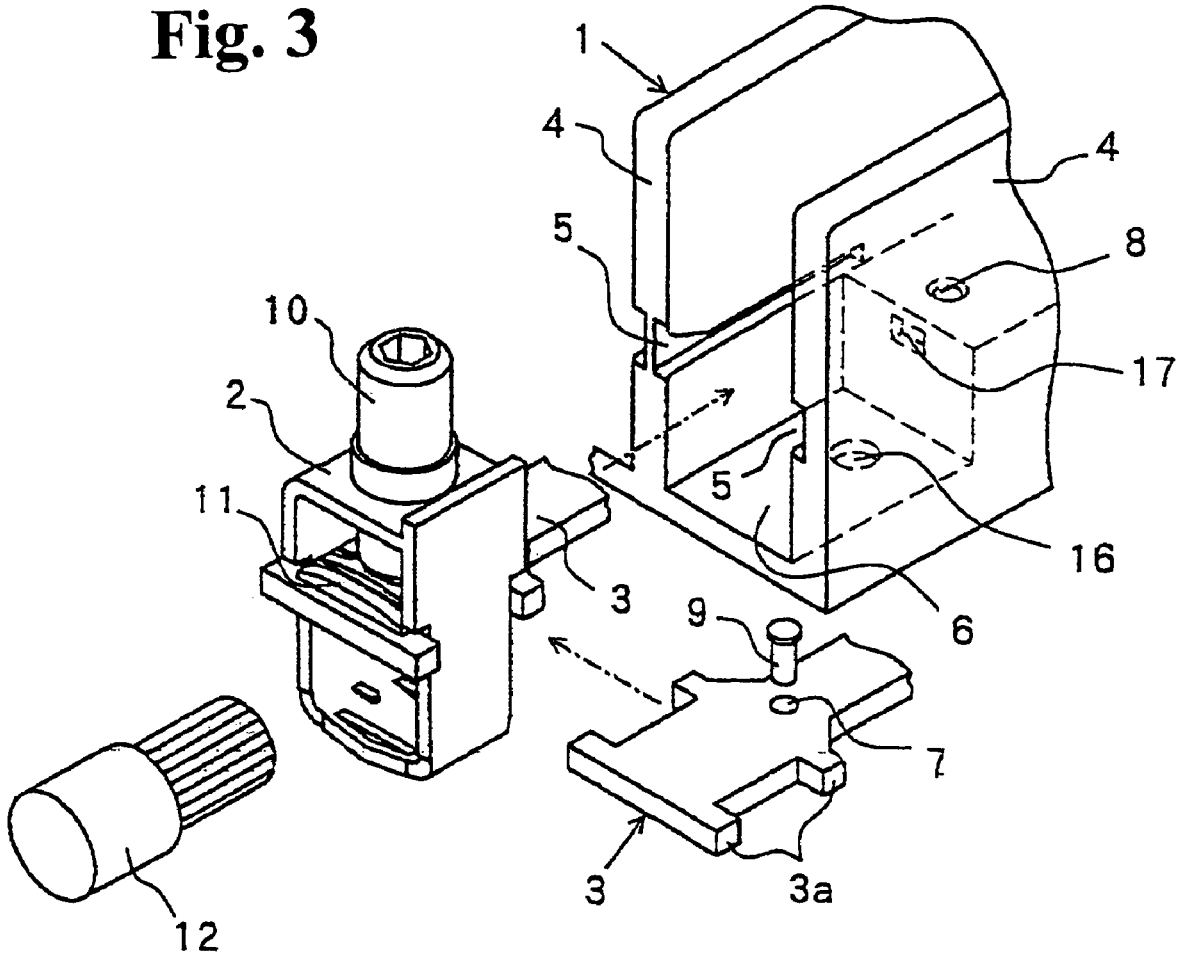
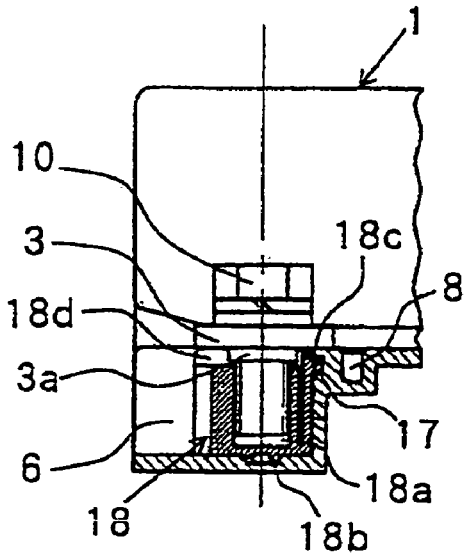
Fig. 4

TERMINAL DEVICE OF ELECTRICAL APPARATUS

BACKGROUND OF THE INVENTION AND RELATED ART STATEMENT

The present invention relates to a terminal device provided in an electrical apparatus such as an electromagnetic contactor, a molded-case circuit breaker, and a terminal base.

A terminal device includes a box terminal device with a box fitting for directly connecting an end of a cable, and a terminal device for connecting a cable with a press terminal at an end thereof. Japanese Patent Publication (Kokai) No. 2002-190331 has disclosed a conventional box terminal device.

FIG. 7 to FIG. 9 show a structure of the conventional box terminal device provided in an electromagnetic contactor. FIG. 7 is a vertical cross sectional view showing the box terminal device, FIG. 8 is a vertical cross sectional view showing the box terminal device in FIG. 7 in a state in which a cable is connected thereto, and FIG. 9 is an exploded perspective view showing the box terminal device in FIG. 7. In FIG. 7 to FIG. 9, particularly in FIG. 9, a terminal strip 3 having a box-shaped terminal fitting 2 is attached to a terminal section provided in a frame 1 made of an insulation material.

In the terminal section, insulation walls 4 are formed on right-hand and left-hand sides of the terminal strip 3. In each of the insulation walls 4 opposite to each other, a rectangular groove 5 (see FIG. 9) is formed in the direction from the front to the rear. A box-like space 6 is formed between the opposing insulation walls 4 for holding the terminal fitting 2.

Two projections 3*a* (see FIG. 9) are formed on each of the right-hand and left-hand sides at an end of the terminal strip 3. The terminal strip 3 is inserted into the grooves 5 from the front to the rear of the frame 1 with the projections 3*a* as shown by an arrow in FIG. 9. The terminal strip 3 is prevented from slipping off from the frame 1 with a pin 9 fitted to a bottom hole 8 in the terminal section through a through hole 7 (see FIG. 9) in the terminal strip 3. The terminal fitting 2 is formed in a box-like shape (rectangular) by die cutting and bending to be fitted slidably up and down to a recess between the projections 3*a* provided on each side of the terminal strip 3. A terminal screw 10 with a hexagonal head hole is screwed into a threaded hole at a top of the terminal fitting 2 with a square washer 11 loosely coupled to the end of the terminal screw 10.

In the terminal device, a stripped end of a cable 12 to be connected is directly inserted into both or one of the upper and lower sides of the terminal strip 3 to be held between the terminal fitting 2 and the terminal strip 3 by tightening the terminal screw 10. A fixed contact point is attached to a right-hand end of the terminal strip 3 (not shown).

FIG. 10 to FIG. 12 show a structure of a conventional terminal device for a press terminal provided in an electromagnetic contactor. FIG. 10 is a vertical cross sectional view showing the terminal device, FIG. 11 is a vertical cross sectional view showing the device in FIG. 10 in a state in which a cable is connected thereto, and FIG. 12 is an exploded perspective view showing the device in FIG. 10. In FIG. 10 to FIG. 12, similar to the box terminal device, a terminal strip 3 to which a terminal screw 10 is screwed in is inserted in a groove 5 in an insulation wall 4 formed in a frame 1. The terminal strip 3 is prevented form slipping off from the frame 1 with a screw section of the terminal screw 10 fitted into a cylinder-like recess 13 provided in the frame 1.

In the terminal device, a cable 12 with a press terminal 14 crimped onto its end is secured to the terminal strip 3 by the terminal screw 10 with the press terminal 14 tightened onto the terminal strip 3. A threaded hole of the terminal strip 3, into which the terminal screw 10 is screwed, has a lower opening processed by burring. A recess 15 is formed around the cylinder-like recess 13 to accommodate a flanged portion 3*a* (see FIG. 10) formed by burring.

In the conventional terminal devices described above, the box terminal device and the terminal device for a press terminal have their respective exclusive frames produced independently of each other. Therefore, for example, the frame for the box terminal device can not be used for the terminal device for the press terminal. Thus, when a connection system is changed after installation of an electrical apparatus, the whole apparatus has to be replaced.

In view of the problems described above, it is an object of the invention to provide a terminal device in which it is possible to easily switch between a cable with a stripped end and a cable with a press terminal.

Further objects and advantages of the invention will be apparent from the following description of the invention.

SUMMARY OF THE INVENTION

In order to attain the objects described above, according to a present invention, a terminal device of electrical apparatus includes a frame capable of receiving at least one conventional terminal strip having a box-shaped terminal fitting. The frame has at least two insulation walls provided in parallel with each other, each having a groove formed in the horizontal direction; a bottom plate made of an insulation material provided between the at least two insulation wails; and a wall standing from the bottom plate. The two adjacent insulation walls, the bottom plate, and the wall form a box-like space for holding the box-shaped terminal fitting. The terminal strip having a box-shaped terminal fitting is inserted into the grooves formed in the insulation walls, and the box-shaped terminal fitting is held in the box-like space with the terminal strip secured to the frame for preventing slip off.

According to the present invention, the terminal device of an electrical apparatus further includes at least one terminal strip having a terminal screw for a press terminal; and at least one attachment piece made of an insulation material and having a cylinder-like recess on an upper face and a projection on a lower face. The attachment piece has a size of being fitted in the box-like space. The bottom plate has a recess for engaging the projection on the lower face of the attachment piece. In a state that the terminal strip having a box-shaped terminal fitting is removed, the attachment piece is inserted in the box-like space, so that the projection on the lower face of the attachment piece is fitted to the recess formed in the bottom plate. The terminal strip having a terminal screw for a press terminal is inserted in the grooves formed in the insulation walls, so that a screw section of the terminal screw is fitted into the cylinder-like recess in the upper face of the attachment piece for preventing the terminal strip from slipping off and the terminal strip is attached to the attachment piece.

In the invention, when the attachment piece is attached and detached, it is possible to use a single frame commonly for both the box terminal device and the terminal device for a press terminal.

According to the invention, the attachment piece may be provided with a resilient claw on a back face thereof. The wall standing from the bottom plate may have a recess formed in a wall face facing the back face of the attachment piece at a position corresponding to the resilient claw, so that the recess engages the resilient claw to thereby hold the attachment piece. Accordingly, the attachment piece can be temporarily held in the frame before the terminal strip is inserted.

In the invention, when the attachment pieces of adjacent phases are connected with a coupling unit provided across the insulation wall between the attachment pieces, it is possible to handle the attachment pieces in a multiphase electrical apparatus as one-piece.

According to the invention, it is possible to use the common single frame for the box terminal device and the terminal device for a press terminal, thereby making it easy to change a cable connection system after an electrical apparatus is installed. It is also possible to reduce manufacturing cost of the frame and make inventory control simple.

BRIEF DESCRIPTION OF THE DRAWINGS

FIG. 3 is an exploded perspective view showing the box terminal device shown in FIG. 1.

FIG. 4 is a vertical cross sectional view showing the terminal device provided as a terminal device for a press terminal according to the embodiment of the invention;

DETAILED DESCRIPTION OF PREFERRED EMBODIMENTS

Figure 1:
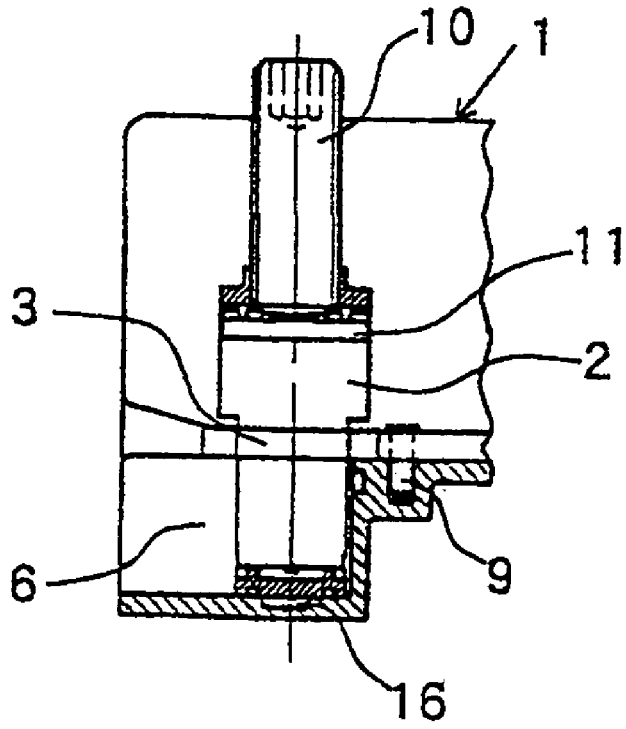
FIG. 1 is a vertical cross sectional view showing a structure of a terminal device provided as a box terminal device according to an embodiment of the invention.
Figure 2:
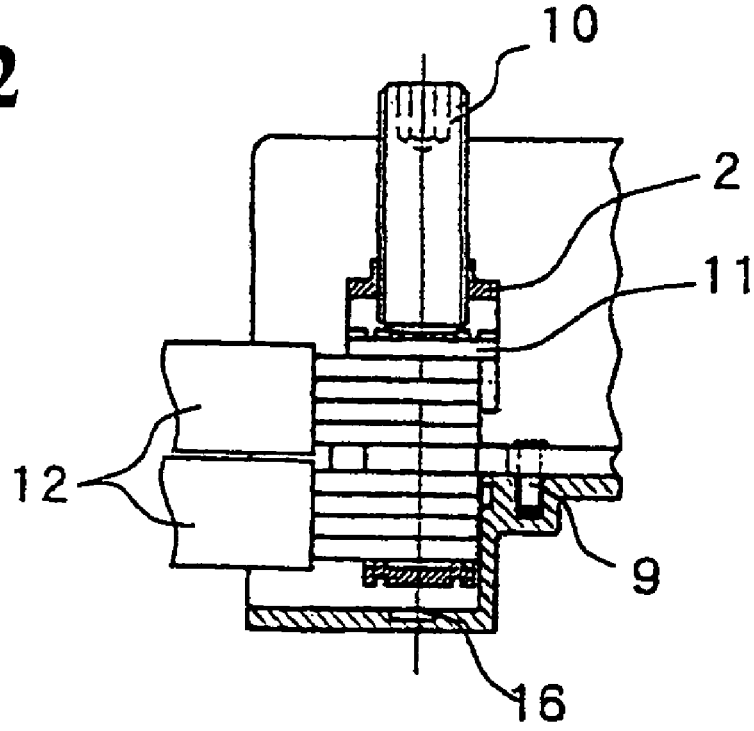
FIG. 2 is a vertical cross sectional view showing the box terminal device shown in FIG. 1 in a state in which a cable is connected thereto.

Hereunder, embodiments of the present invention will be explained with reference to FIG. 1 to FIG. 6. The parts corresponding to those in the conventional devices are designated by the same reference numerals and signs. FIG. 1 to FIG. 3 show a terminal device provided as a box terminal device according to an embodiment of the invention. FIG. 1 is a vertical cross sectional view showing a structure of the box terminal device, FIG. 2 is a vertical cross sectional view showing the box terminal device in FIG. 1 in a state in which a cable is connected thereto, and FIG. 3 is an exploded perspective view showing the box terminal device in FIG. 1.

Figure 7:
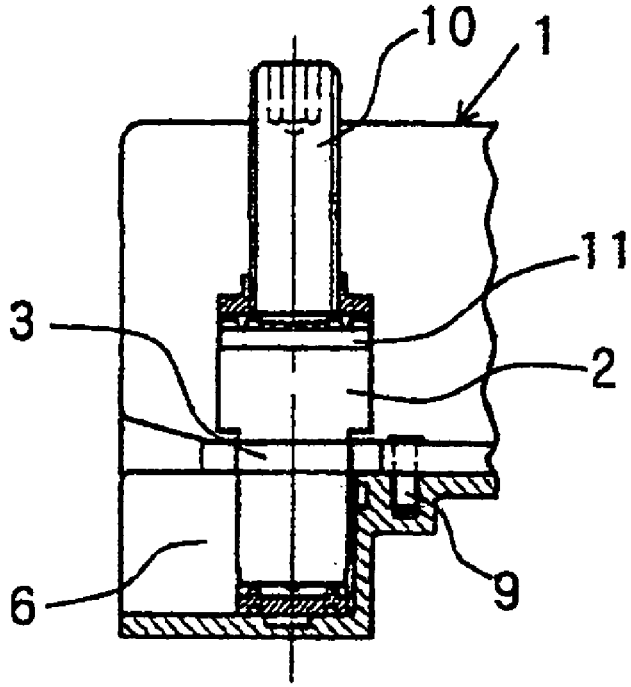
Fig. 7 Prior Art
FIG. 7 is a vertical cross sectional view showing a structure of a conventional box terminal device.
Figure 8:
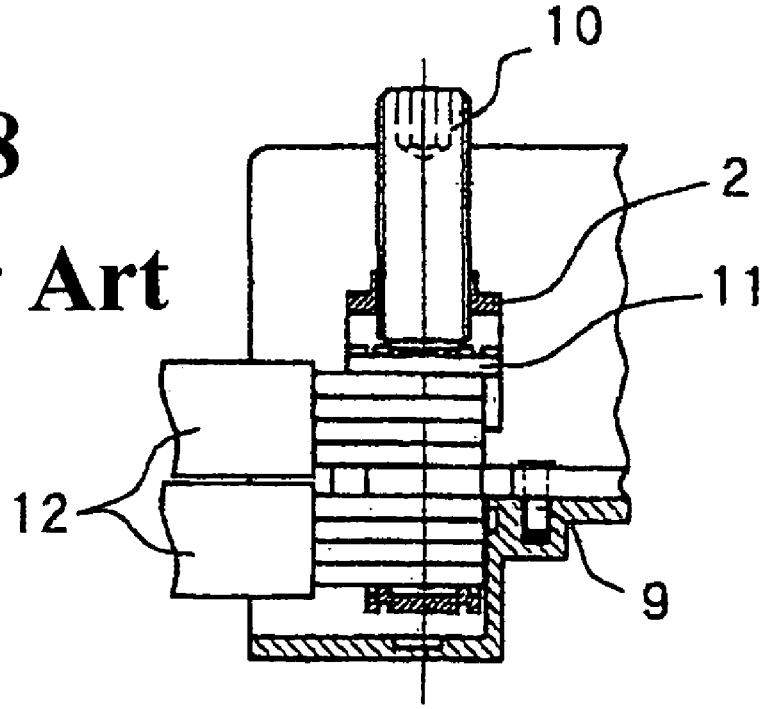
Fig. 8 Prior Art
FIG. 8 is a vertical cross sectional view showing the box terminal device shown in FIG. 7 in a state in which a cable is connected thereto.
Figure 9:
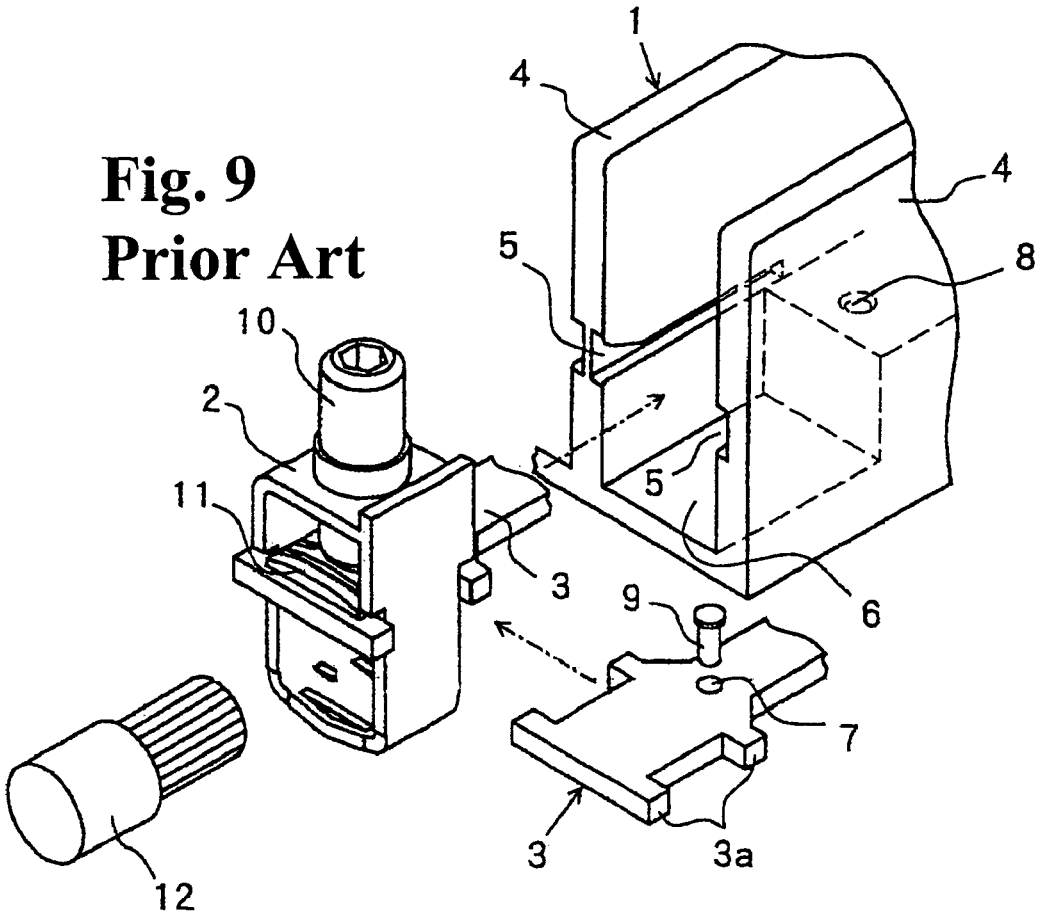
Fig. 9 Prior Art
FIG. 9 is an exploded perspective view showing the box terminal device shown in FIG. 7.
Figure 10:
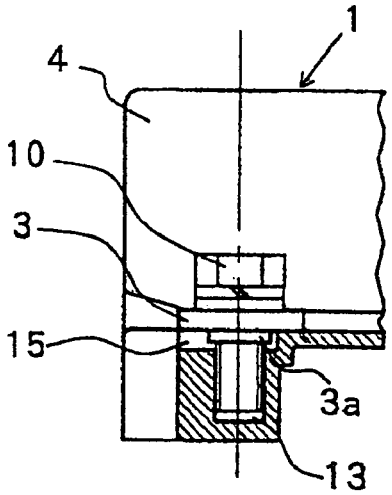
Fig. 10 Prior Art
FIG. 10 is a vertical cross sectional view showing a structure of a conventional terminal device for a press terminal.
Figure 11:
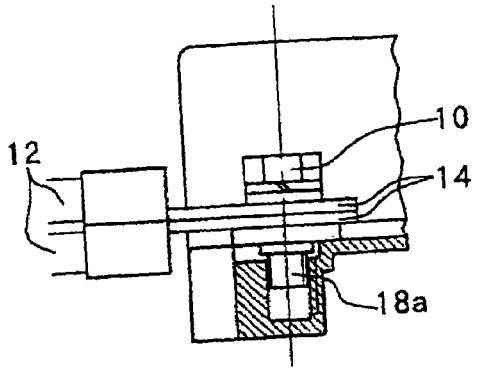
Fig. 11 Prior Art
FIG. 11 is a vertical cross sectional view showing the terminal device for a press terminal shown in FIG. 10 in a state in which a cable is connected thereto.
Figure 12:
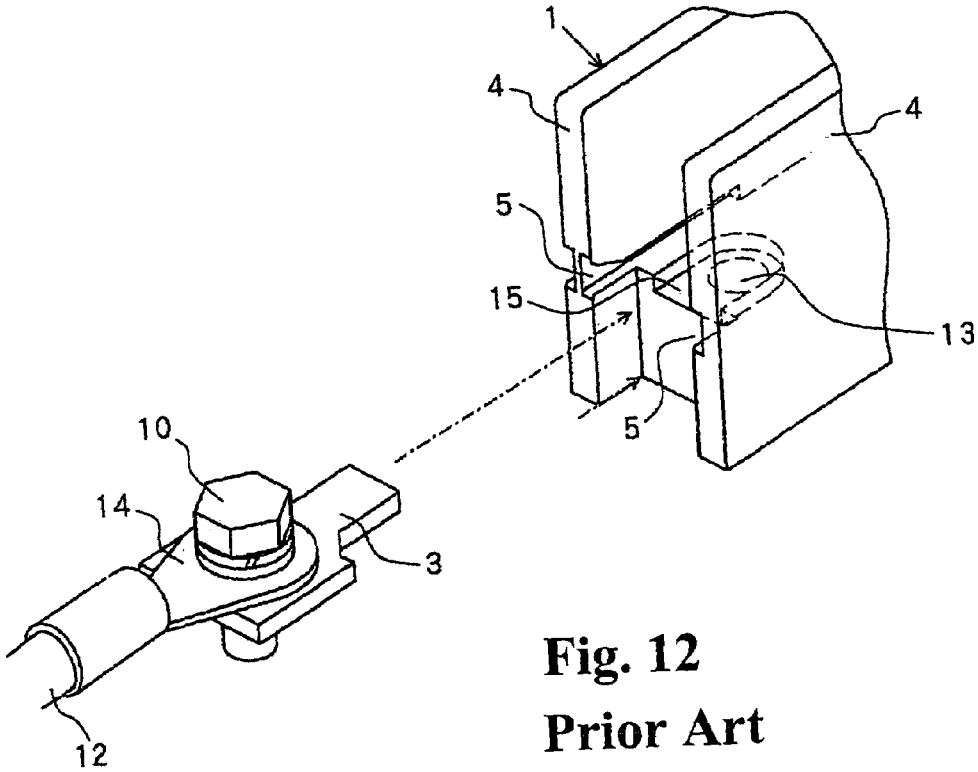
Fig. 12 Prior Art
FIG. 12 is an exploded perspective view showing the terminal device for a press terminal shown in FIG. 10.

In FIG. 1 to FIG. 3, differences from the conventional device in FIG. 7 to FIG. 9 are that a bottom plate of a frame 1 forming a box-like space 6 has a cylinder-like shallow recess 16, and a wall standing from the bottom plate and forming the box-like space 6 has a rectangular shallow recess 17 (see FIG. 3). Structures of a terminal fitting 2 and a terminal strip 3 are the same as those in the conventional terminal device. Similar to the conventional terminal device, a terminal strip 3 is attached to the frame 1, and a stripped wire 12 is connected thereto.

Figure 5:
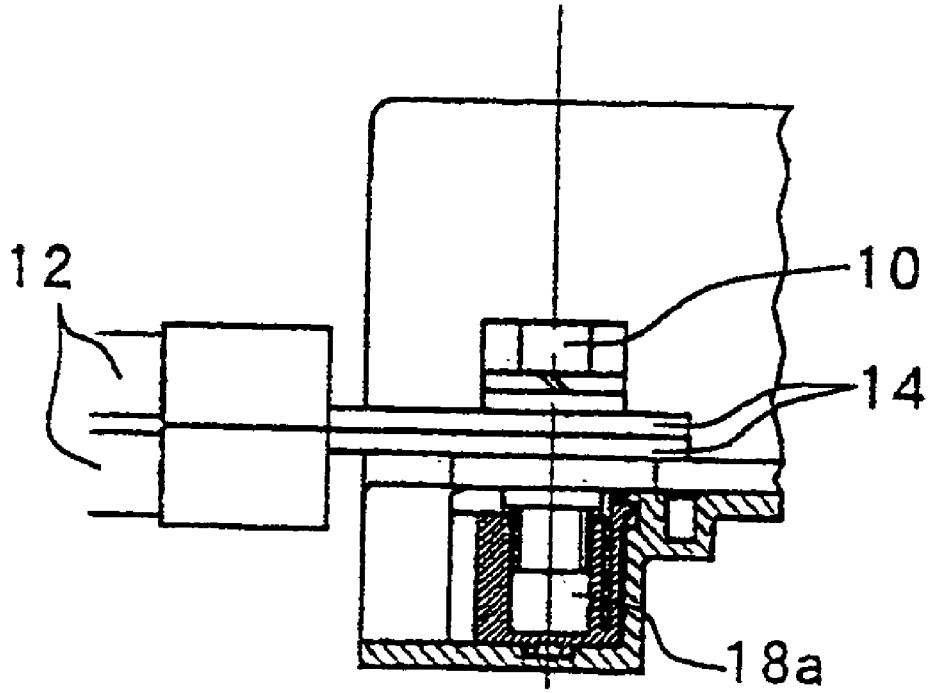
FIG. 5 is a vertical cross sectional view showing the terminal device for a press terminal shown in FIG. 4 in a state in which a cable is connected thereto.
Figure 6:
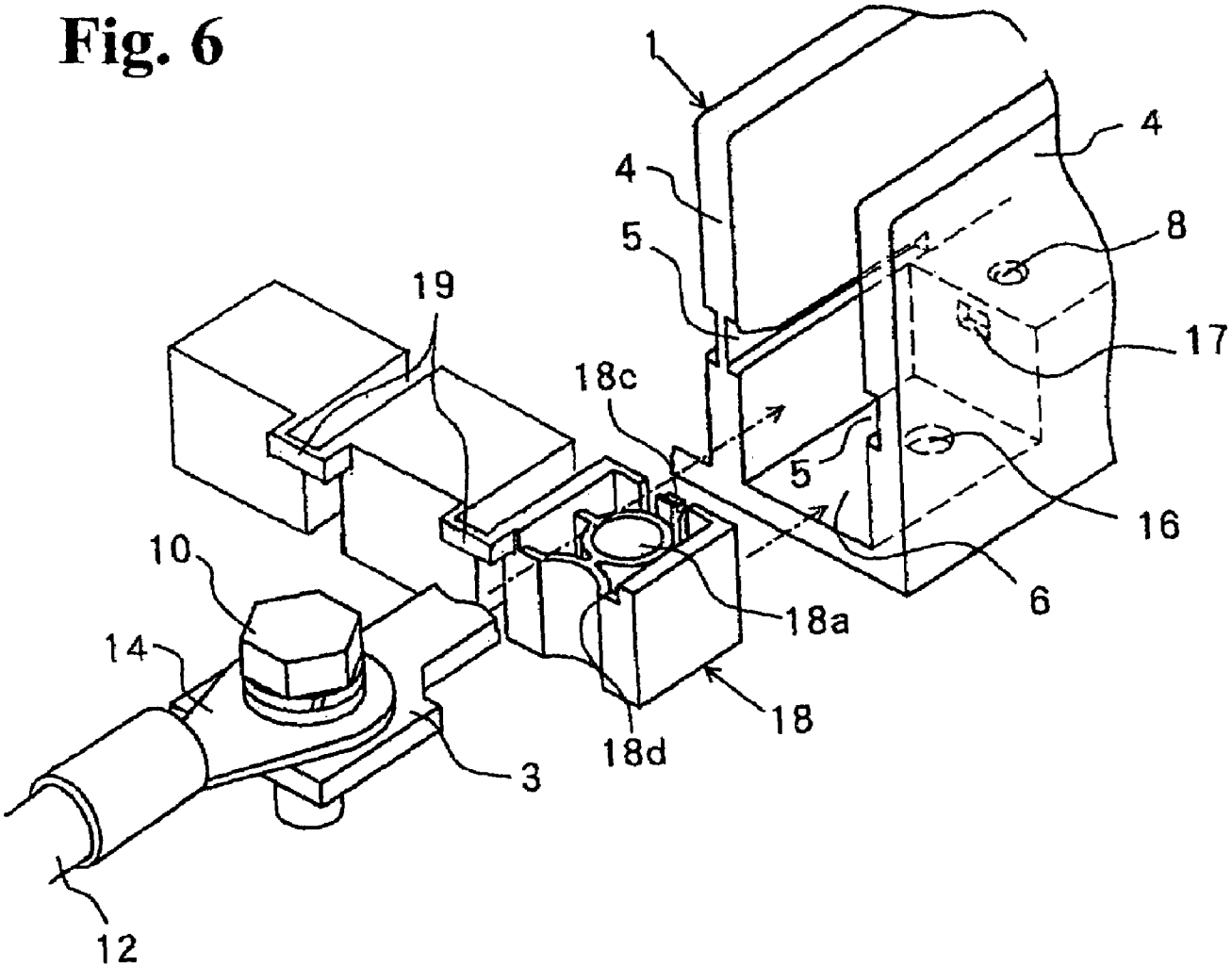
FIG. 6 is an exploded perspective view showing the terminal device for a press terminal shown in FIG. 4.

FIG. 4 to FIG. 6 show a terminal device provided as a terminal device for a press terminal as another embodiment according to the invention. FIG. 4 is a vertical cross sectional view showing a structure of the terminal device for a press terminal, FIG. 5 is a vertical cross sectional view showing the terminal device for a press terminal in FIG. 4 in a state in which a cable is connected thereto, and FIG. 6 is an exploded perspective view showing the terminal device for a press terminal in FIG. 4.

In FIG. 4 to FIG. 6, difference from the conventional device in FIG. 7 to FIG. 9 are that an attachment piece 18 made of an insulation material is provided in the above frame 1 in addition to the recesses 16 and 17 therein. The attachment piece 18 is made of a molded resin like the frame 1, and formed in a cube-like shape with its width and height fitting the box-like space 6 in the frame 1. The attachment piece 18 has a cylinder-like recess 18*a* on the upper face thereof and a low column-like projection 18*b* (see FIG. 4) on the lower face thereof. The column-like projection 18*b* fits the recess 16 in the bottom plate of the frame 1 forming the box-like space 6.

On the back of the attachment piece 18, a resilient claw 18*c* is provided for fitting into the recess 17 in the surface of the wall standing from the bottom plate forming the box-like space 6 in the frame 1. The resilient claw 18*c* is formed in a tongue-like piece flexibly standing with a clearance provided between surroundings. In a three-phase electromagnetic contactor, three attachment pieces 18 are used as shown in FIG. 6. Of the three attachment pieces 18, two attachment pieces 18 of adjacent phases are coupled to each other by a U-shape coupling unit 19 provided across an insulation wall 4. The structure of a terminal strip 3 having a terminal screw 10 is the same as that in the conventional terminal device.

In the terminal device shown in FIG. 4 to FIG. 6, when the terminal device for a press terminal is attached to the frame 1 instead of the box terminal device, the attachment piece 18 is first inserted into the box-like space 6 in a state that the box terminal device is removed. At this time, the projection 18*b* is fitted to the recess 16 in the surface of the bottom plate of the frame 1 forming the box-like space 6.

The resilient claw 18*c* on the back of the attachment piece 18 is fitted to the recess 17 in the surface of the wall standing from the bottom plate and forming the box-like space 6. In this state, the attachment piece 18 is restrained from moving back and forth and moving up and down by the projection 18*b* and the resilient claw 18*c*, respectively, to be temporarily held in the frame 1. Then, the terminal strip 3 with the terminal screw 10 detached is inserted into the groove 5 to position the threaded hole in the terminal strip 3 for the terminal screw 10 over the cylinder-like recess 18*a* in the attachment piece 18. Then, the terminal screw 10 is screwed into the terminal strip 3 to fit the threaded section of the screw 10 into the cylinder-like recess 18*a* in the attachment piece 18. Accordingly, the terminal strip 3 does not slip off from the attachment piece 18.

To the terminal strip 3, a cable 12 provided with a press terminal 14 is connected in the same way as in the conventional device. For avoiding the flanged portion 3*a* protruding from the terminal strip 3, the upper face of the attachment piece 18 is recessed by providing a step 18*d*.

In the embodiments, by only attaching the attachment piece 18, the frame 1 for a box terminal device can be commonly used for a terminal device for a press terminal without an exclusive frame for each of the terminal devices. Therefore, even after an electromagnetic contactor is installed, connection system can be changed without replacing the main body of the contactor. In manufacturing a magnetic contactor, the number of frames is reduced, thereby reducing manufacturing cost and making inventory control easy. Furthermore, by making the attachment piece 18 temporarily held to the frame 1 with the resilient claw 18*c* and by making attachment pieces for multiphase terminals integrated with the coupling units 19, assembling work of the terminal device becomes easy.

In the embodiments, the electromagnetic contactor is shown as an example of the electrical-apparatus. The invention can be applied to other kinds of electrical apparatus having terminal devices such as a molded-case circuit breaker and a terminal base.

The disclosure of the Japanese Patent Application No. 2004-140733 filed on May 11, 2004 is incorporated in the application.

While the present invention has been explained with reference to the specific embodiments of the invention, the explanation is illustrative and the invention is limited only by the appended claims.

What is claimed is:

1. A terminal device of an electrical apparatus comprising:

a frame including at least two side walls with grooves, a bottom wall disposed between the at least two side walls and having a first recess, and a rear wall standing from the bottom wall to form a box-shaped space, at least one attachment piece fitted into the box-shaped space, and having a cylinder-shaped recess and a lower surface with a projection for engaging the first recess, and at least one terminal strip with a terminal screw to be inserted into the box-shaped space along the grooves so that the terminal screw is fitted into the cylinder-shaped recess for attaching the terminal strip to the attachment piece.

2. A terminal device according to claim 1, wherein said attachment piece further includes a resilient claw on a back surface thereof, and said rear wall includes a second recess for engaging the resilient claw.

3. A terminal device according to claim 1, further comprising another attachment piece connected to the attachment piece with a coupling unit disposed across one of the two side walls between the another attachment piece and the attachment piece.

4. A terminal device according to claim 1, further comprising a terminal fitting having another terminal strip, said terminal fitting being able to be inserted into the box-shaped space when the at least one attachment piece is not attached to the frame.

* * * * *

UNITED STATES PATENT AND TRADEMARK OFFICE

CERTIFICATE OF CORRECTION

PATENT NO. : 6,981,901 B2
DATED : January 3, 2006
INVENTOR(S) : Kouetsu Takaya

It is certified that error appears in the above-identified patent and that said Letters Patent is hereby corrected as shown below:

Title page,
Item [57], ABSTRACT,
Line 3, "screw, The" should read -- screw, the --.

Column 2,
Line 37, "wails" should read -- walls --.

Signed and Sealed this

Eighteenth Day of April, 2006

JON W. DUDAS
*Director of the United States Patent and Trademark Office*